United States Patent [19]

Patron et al.

[11] Patent Number: 4,848,375

[45] Date of Patent: Jul. 18, 1989

[54] FILTER CIGARETTE

[75] Inventors: Gregorio I. Patron, Midlothian; Walter A. Nichols; Paul N. Gauvin, both of Richmond; Francis M. Sprinkel, Jr., Glen Allen, all of Va.

[73] Assignee: Philip Morris Incorporated, New York, N.Y.

[21] Appl. No.: 119,047

[22] Filed: Nov. 10, 1987

[51] Int. Cl.[4] ..... A24D 3/04; A24D 3/06

[52] U.S. Cl. ..... 131/335; 131/336; 131/198.2

[58] Field of Search ..... 131/335, 336, 198.1, 131/198.2

[56] References Cited

U.S. PATENT DOCUMENTS

| | | |
|---|---|---|
| 2,954,035 | 9/1960 | Saffir . |
| 3,016,902 | 1/1962 | Lipp et al. . |
| 3,359,988 | 12/1967 | Thomson . |
| 3,428,050 | 2/1969 | Kandel . |
| 3,463,166 | 8/1969 | Bennett et al. . |
| 3,515,146 | 6/1970 | Nealis . |
| 3,596,665 | 8/1971 | Lindgard . |
| 4,532,943 | 8/1985 | Nichols et al. . |
| 4,649,944 | 3/1987 | Houck, Jr. et al. . |
| 4,677,995 | 7/1987 | Kallianos et al. . |

FOREIGN PATENT DOCUMENTS

| | | |
|---|---|---|
| 1058343 | 2/1967 | United Kingdom . |
| 1095848 | 12/1967 | United Kingdom . |

*Primary Examiner*—Vincent Millin

*Attorney, Agent, or Firm*—Jeffrey H. Ingerman

[57] ABSTRACT

A filter cigarette is provided in which the smoker can select different flavorants or filter media for interposition in the smoke stream. A filter segment having two flow paths, each containing different flavoring or filtering media, cooperates with one or two rotatable end caps having openings for selective registration with the flow paths, are used to select the desired flow path. A method of delivering "air-swept flavor" is also provided.

34 Claims, 4 Drawing Sheets

FILTER CIGARETTE

BACKGROUND OF THE INVENTION

This invention relates to filter cigarettes. More particularly, this invention relates to filter cigarettes of the type in which the smoker can control the degree of filtration and the addition of flavorants to the smoke stream.

It is known to produce filter cigarettes having rotatable or axially movable elements, particularly in association with the filter assembly of the cigarette, for controlling one or more smoking characteristics of the cigarette. In particular, commonly-assigned U.S. Pat. No. 4,532,943 shows a cigarette in which the filter has two relatively rotatable segments which can be used to control one or more of the air dilution value, the resistance-to-draw, and the amount of added flavorant in the smoke stream, of the cigarette. Commonly-assigned U.S Pat. No. 4,649,944 shows a filter cigarette having an axially movable filter segment for controlling one or more of the same characteristics. Other cigarettes are known in which the amount of added flavorant can be controlled by the smoker.

In these and other known cigarettes, the initial condition of the cigarette is one in which no flavorant is added to the smoke stream. Movement of a control element in those cigarettes, whether rotationally, axially, or otherwise, usually ruptures a flavorant capsule or other flavorant-containing element. In some of those cigarettes, increasing movement of the control element ruptures increasing s numbers of flavorant-containing elements, so that the smoker can choose the amount of flavorant to add. However, once the flavorant-containing elements have been ruptured, there is no means provided for resealing them to lessen the amount of added flavorant or to completely eliminate it. In addition, because there is no way to control which of the individual flavorant-containing elements are ruptured at a particular time, these cigarettes can only provide a choice of one flavorant.

It is also known to provide cigarette-like articles in which the user inhales air through the article. The article is impregnated with a flavorant designed to simulate smoking without the combustion of tobacco. However, none of these articles provides a choice between such "air-swept flavor" and actual tobacco smoke under the control of the user.

Commonly-assigned U.S. Pat. No. 4,677,995, shows a filter cigarette in which a smoker could select from among a number of flavorants, and could increase or decrease the amount of added flavorant.

It would be desirable to be able to provide other embodiments of a filter cigarette in which the smoker could both increase and decrease the amount of flavorant added to the smoke stream. It would also be desirable to be able to provide other embodiments of a filter cigarette in which a smoker could select one or more of a number of flavorants to be added to the smoke stream.

It would further be desirable to be able to provide a cigarette in which the smoker has a choice between "air-swept flavor" and actual tobacco smoke.

SUMMARY OF THE INVENTION

It is an object of this invention to provide other embodiments of a filter cigarette in which the smoker could both increase and decrease the amount of flavorant added to the smoke stream.

It is also an object of this invention to provide other embodiments of a filter cigarette in which a smoker could select one or more of a number of flavorants to be added to the smoke stream.

It is a further object of this invention to provide a cigarette in which the smoker has a choice between "air-swept flavor" and actual tobacco smoke.

In accordance with this invention, there is provided a filter cigarette having a substantially cylindrical tobacco rod, a substantially cylindrical filter assembly, and tipping paper circumscribing and joining the filter assembly and the tobacco rod. The filter assembly includes a first filter assembly segment having a substantially cylindrical substantially smoke-impervious wall, a mouth end, a rod end, and two substantially semicylindrical fluid flow paths therethrough separated by barrier means, the barrier means being at least substantially smoke-impervious. At least one of the fluid flow paths contains a flavoring medium. The filter assembly also includes at least a second filter assembly segment abutting the mouth end of the first filter assembly segment and rotatable relative thereto for selectively directing fluid flow into a smoker's mouth from one of the fluid flow paths, and preventing fluid flow into said smoker's mouth from the other of the fluid flow paths, the second filter assembly segment being a substantially cylindrical cap of an at least substantially smoke-impervious material, the cap having an open end for fitting over the mouth end of the first filter assembly segment and having a substantially semicircular opening in the end opposite the open end for registration with one of the semicylindrical fluid flow paths.

There is also provided a filter cigarette in which one of the flow paths is closed at the rod end, the closed flow path having openings communicating with outside air. The flow path contains a flavorant chosen to provide a desired flavor when carried into a smoker's mouth by a current of air substantially at room temperature. The current of air is provided when a smoker draws on the cigarette and air is drawn in through the openings.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
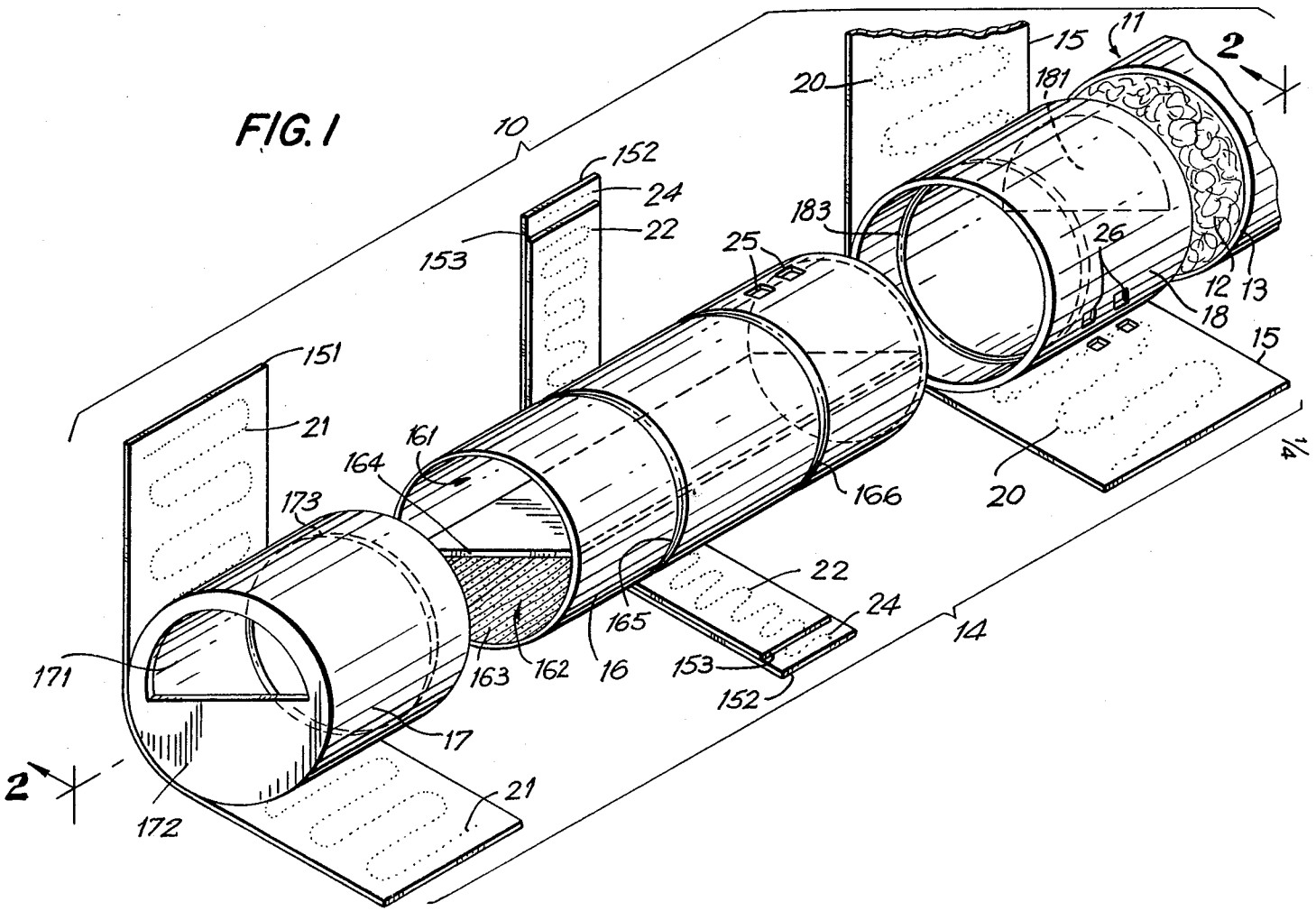
FIG. 1 is a fragmentary, partially exploded perspective view taken from the mouth end of one embodiment of a filter cigarette according to this invention.
Figure 2:
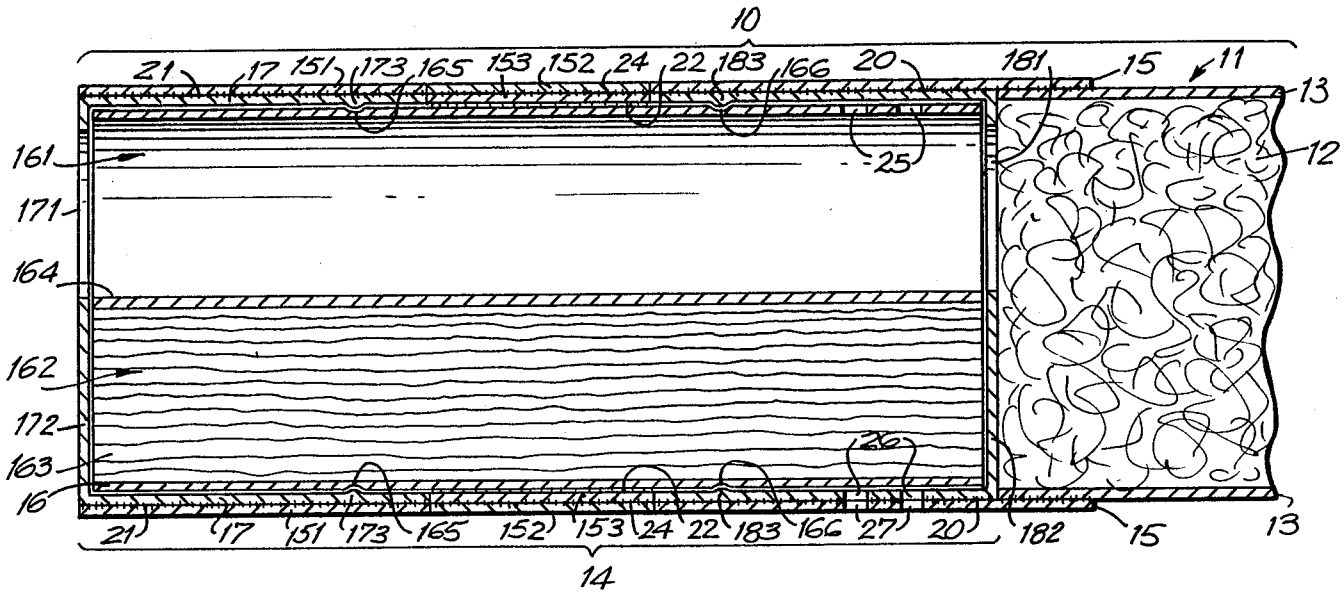
FIG. 2 is a fragmentary, longitudinal cross-sectional view of the cigarette of FIG. 1, taken from line 2—2 of FIG. 1, but not exploded.

A first embodiment 10 of a filter cigarette according to this invention is shown in FIGS. 1 and 2. Cigarette 10 includes a tobacco rod 11—that is, a charge of tobacco 12 wrapped in cigarette paper 1—and a filter assembly 14 circumscribed and joined to tobacco rod 11 by tipping paper 15. Filter assembly 14 includes a first filter assembly segment 16, and second and third filter assembly segments 17, 18 abutting, and rotatable relative to, segment 16.

Segment 16 contains two semicircular flow paths 161, 162 for smoke or other fluids, such as air. As shown in FIGS. 1 and 2, fluid flow path 161 is empty, and fluid flow path 162 contains a carrier medium 163 impregnated with a flavorant material. The two paths 161, 162 are separated by an at least substantially smoke-impervious barrier 164. The walls of segment 16, as well as barrier 164, can be made of any substantially smoke-impervious material such as, for example, an extruded or molded thermoplastic material.

Segments 17, 18 are in the form of cylindrical caps, also preferably of a substantially smoke-impervious material such as extruded or molded thermoplastic material, which fit over the ends of segment 16. Each segment 17, 18 has a semicircular opening 171, 181 in the end wall 172, 182 thereof for alignment with one or the other of flow paths 161, 162. Segment 17 is retained against axial displacement relative to segment 16 by detent ring 173 on the inner surface of segment 17 and a cooperating detent groove 165 in the outer surface of segment 16. Similarly, segment 18 is retained against axial displacement by the cooperation of detent ring 183 and groove 166. It will be understood that alternatively the detent rings could be provided on segment 16 with the grooves being provided on the inner surfaces of segments 17, 18, and that instead of rings, one or more projections (not shown) could be provided to engage the respective groove. This detent arrangement prevents relative axial displacement while allowing freedom of rotation. Stops (not shown) may also be provided to limit axial rotation to a desired range.

A section of tipping paper 15 overlies segment 18 and tobacco rod 11 and is adhered to both by adhesive band 20. Although tipping section 15 alone is sufficient to assemble filter assembly 14, for aesthetic reasons, additional tipping paper sections are provided. Tipping section 151 overlies segment 17 and is adhered thereto by adhesive band 21. Tipping section 152 overlies the portion of segment 16 not covered by either of segments 17, 18. However, in order to present a smooth external appearance, a spacer 153, which could be a layer of tipping paper, is provided intermediate segment 16 and tipping section 152. Spacer layer 153 is adhered to segment 16 by adhesive band 22, and tipping section 152 is adhered to spacer layer 153 by adhesive band 24. Alternatively, segment 16 could be formed with a section of increased thickness in the area of spacer layer 153, eliminating the need for a spacer.

As mentioned above, in the embodiment shown in FIGS. 1 and 2 fluid flow path 161 is empty, and fluid flow path 162 contains a carrier medium 163 impregnated with a flavorant material. Segment 17, which selectively directs fluid flow from one of paths 161, 162 into the smoker's mouth and prevents fluid flow into the smoker's mouth from the other of flow paths 161, 162, and segment 18, which selectively directs smoke flow from tobacco rod 11 through one of paths 161, 162 and excludes it from the other of paths 161, 162, have been rotated to align both openings 171, 181 with flow path 161, providing unfiltered smoke. If both segments 17, 18 were rotated to align openings 171, 181 with flow path 162, smoke would flow through carrier medium 163, providing flavored smoke. Alternatively, flow path 161 could also be provided with a flavored carrier medium, allowing a choice of flavorants depending on which of flow paths 161, 162 openings 171, 181 are aligned with. It will be understood that any carrier medium provided according to this invention may also be a filter medium. Thus the invention can provide a choice between (1) unfiltered unflavored smoke and unfiltered flavored smoke, (2) unfiltered unflavored smoke and filtered unflavored smoke, (3) unfiltered unflavored smoke and filtered flavored smoke, (4) two different unfiltered flavored smokes, (5) two different filtered flavored smokes, (6) unfiltered flavored smoke and filtered unflavored smoke, or (7) unfiltered flavored smoke and filtered flavored smoke.

In addition, flow path 161 could be provided with a carrier medium containing a flavorant compound designed to provide a desired flavor when carried into a smoker's mouth by a current of air substantially at room temperature. In such an embodiment, openings 25 would be provided in segment 16 near its rod end, and corresponding openings 26, 27 would be provided in segment 18 and tipping 15 overlying openings 25. The choices discussed in the preceding paragraph would still be available provided openings 171, 181 are both aligned with the same one of paths 161, 162, although, depending on the nature of the flavorant in path 161, it may not be desirable to draw smoke through that path. However, when opening 171 is aligned with path 161 and opening 181 is aligned with path 162, the smoker's mouth is in contact with path 161, but path 161 is isolated from tobacco rod 11. Openings 26, 27 are placed so that they register with openings 25 in this position. Therefore, when segments 17, 18 are in this position, the smoker draws air through opening 25, 26, 27 through the flavored medium in path 161 into the mouth, providing a smokeless flavor sensation referred to as "air-swept flavor".

Figure 3:
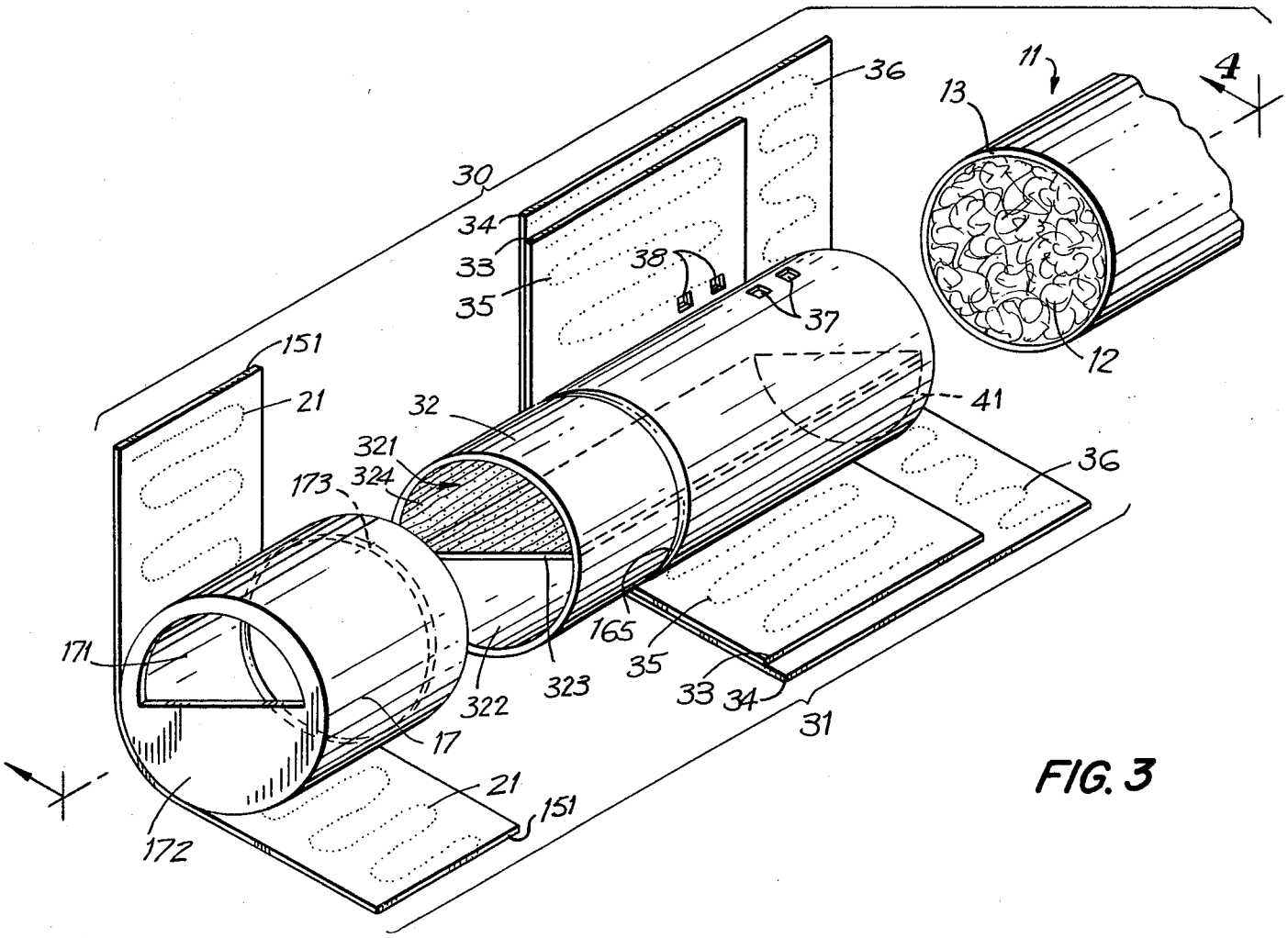
FIG. 3 is a fragmentary, partially exploded perspective view taken from the mouth end of a second embodiment of a filter cigarette according to this invention.
Figure 4:
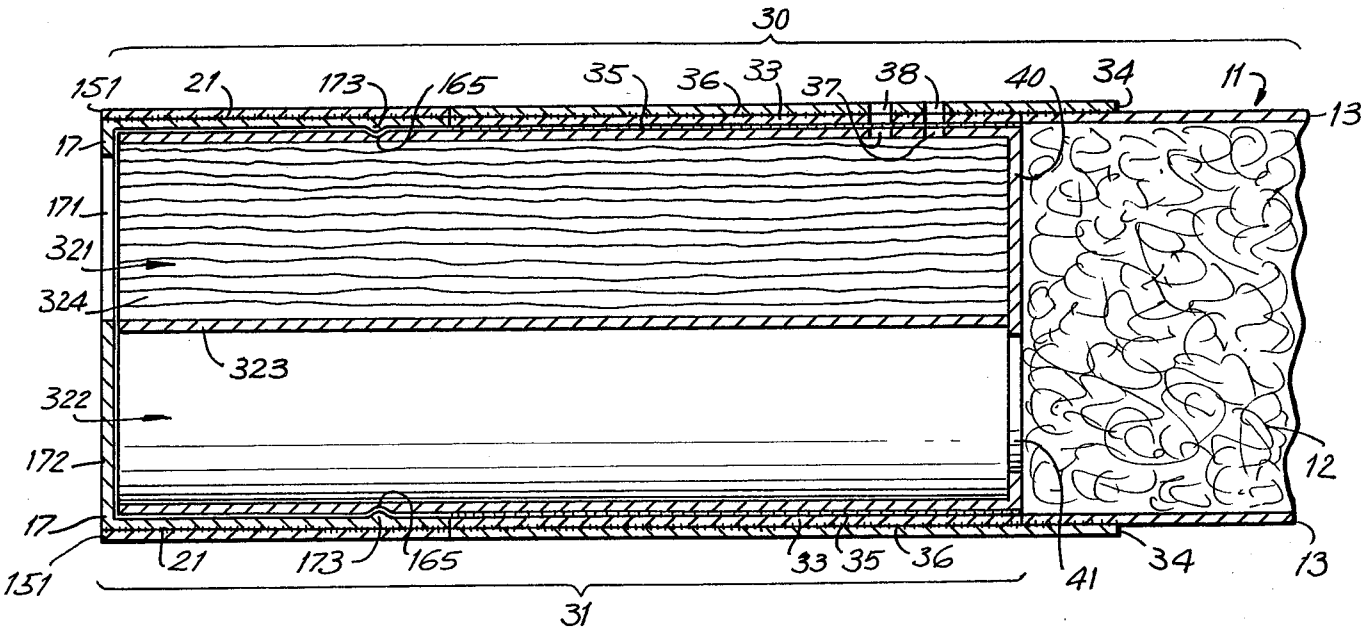
FIG. 4 is a fragmentary, longitudinal cross sectional view of the cigarette of FIG. 3, taken from line 4—4 of FIG. 3, but not exploded.

A second embodiment 30 of a filter cigarette according to this invention is shown in FIGS. 3 and 4. Cigarette 30 has a tobacco rod 11 as in cigarette 10, and a filter assembly 31 including first filter assembly segment 32 and second filter assembly segment 17. Filter assembly segment 17 is identical to segment 17 of cigarette 10. Filter assembly segment 32 is similar to segment 16 of cigarette 10, having fluid flow paths 321, 322 separated by substantially smoke-impervious barrier 323. Segment 32 differs, however, from segment 16 in that the rod end of fluid flow path 321 is closed off by substantially smoke-impervious closure member 40, while path 322 is open at 41. There is no third filter assembly segment in cigarette 30. Therefore, segment 32 has a groove 165 for receiving detent ring 173, but has no groove corresponding to groove 166 of segment 16.

As in cigarette 10, segment 17 is overlain by tipping section 151, adhered with adhesive band 21. The portion of segment 32 not covered by segment 17 is overlain by spacer wrap 33 to match the thickness of segment 17, and spacer wrap 33 is in turn overlain by tipping section 34, which also overlies a portion of tobacco rod 11. Spacer wrap 33 is adhered to segment 32 by adhesive band 35, and tipping section 34 is adhered to spacer wrap 33 and to cigarette paper 13 by adhesive band 36. Openings 37 are provided in segment 32 communicating with path 321, and corresponding openings 38 in spacer wrap 33 and tipping section 34 register with openings 37.

When segment 17 is adjusted so that opening 171 is in registry with path 322, then the smoker receives untreated smoke if there is no medium inserted in path 322, or smoke treated by whatever medium is inserted in path 322, be it an unflavored filter, a flavored filter, or a flavor carrier that is not a filter. In any event, path 321 is provided with a carrier medium 324 containing a flavorant compound designed to provide a desired flavor when carried into a smoker's mouth by a current of air substantially at room temperature, as in carrier medium 163 described above. Thus when opening 171 is in registry with path 321, the smoker receives "air-swept flavor" as defined above.

By including in either cigarette 10, 30 "air-swept flavor" paths, "no-flavor" paths, paths of different flavors, paths of different concentrations of the same flavor, or combinations of these alternatives, a cigarette can be provided in which flavor can be turned "on" and "off", different flavors or combinations of flavors can be selected, or different levels of one or more flavors can be selected.

Further, in either cigarette 10, 30 a conventional filter segment of cellulose acetate or other filter material can be included either at the mouth end of filter assembly 14, 31, or between tobacco rod 11 and filter assembly 14, 31, or in both places.

Thus, a cigarette is provided in which a smoker can vary the amount of flavorant added to the smoke stream, or select one or more of a number of flavorants, including "air-swept flavor". One skilled in the art will appreciate that the present invention can be practiced by other than the described embodiments, which are presented for purposes of illustration and not of limitation, and the present invention is limited only by the claims which follow.

What is claimed is:

1. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a substantially cylindrical substantially smoke-impervious wall, a mouth end, a rod end, and two substantially semicylindrical fluid flow paths therethrough separated by barrier means, said barrier means being at least substantially smoke-impervious, at least one of said fluid flow paths containing a flavoring medium; and at least a second filter assembly segment abutting said mouth end of said first filter assembly segment and rotatable relative thereto for selectively directing fluid flow into a smoker's mouth through one of said fluid flow paths, and preventing fluid flow into said smoker's mouth from the other of said fluid flow paths, said second filter assembly segment being a substantially cylindrical cap of an at least substantially smoke-impervious material, said cap having an open end for fitting over said mouth end of said first filter assembly segment and having a substantially semicircular opening in the end opposite said open end for registration with one of said semicylindrical fluid flow paths.

2. The filter cigarette of claim 1 further comprising means for retaining said cap against axial displacement relative to said first filter assembly segment.

3. The filter cigarette of claim 2 wherein said retaining means comprises detent means on said cap and said first filter assembly segment.

4. The filter cigarette of claim 1 wherein only one of said fluid flow paths contains a flavored filter medium, the other of said flow paths containing an unflavored filter medium.

5. The filter cigarette of claim 4 wherein:

said flavored medium containing flow path is closed at said rod end by closure means, said closure means being at least substantially smoke-impervious;

said flavored medium is flavored with a flavoring chosen to provide a desired flavor when carried into a smoker's mouth by a current of air substantially at room temperature; and said first filter assembly segment has at least one opening in said wall communicating with said flavored medium containing flow path, whereby when said second filter assembly segment is rotated to direct fluid flow through said flavored medium containing flow path, air only is drawn through said flavored medium containing flow path, carrying said flavoring into said smoker's mouth.

6. The filter cigarette of claim 4 further comprising a third filter assembly segment adjacent said rod end of said first filter assembly segment for selectively directing smoke flow from said tobacco rod through one of said fluid flow paths, and excluding it from the other of said fluid flow paths, whereby:

when said second and third filter assembly segments are rotated to select said flavored medium containing flow path flavored filtered smoke is delivered to said smoker's mouth; and when said second and third filter assembly segments are rotated to select said other flow path, unflavored filtered smoke is delivered to said smoker's mouth.

7. The filter cigarette of claim 6 wherein said third filter assembly segment is a substantially cylindrical cap of an at least substantially smoke-impervious material, said cap having an open end for fitting over said rod end of said first filter assembly segment and having a substantially semicircular opening in the end opposite said open end for registration with one of said semicylindrical fluid flow paths.

8. The filter cigarette of claim 7 further comprising means for retaining said third filter assembly segment against axial displacement relative to said first filter assembly segment.

9. The filter cigarette of claim 8 wherein said retaining means further comprises detent means on said second and third filter assembly segments.

10. The filter cigarette of claim 6 wherein:

said first filter assembly segment has at least one opening in said wall communicating with said flavored medium containing flow path; and said flavored medium is flavored with a flavoring chosen to provide a desired flavor when carried into a smoker's mouth by a current of air substantially at room temperature; whereby:

when said second filter assembly segment is rotated to select said flavored medium containing flow path and said third filter assembly segment is rotated to select said other flow path, said flavored medium containing flow path is closed at said rod end, said other flow path is closed at said mouth end, and air only is drawn through said flavored medium containing flow path, carrying said flavoring into said smoker's mouth.

11. The filter cigarette of claim 10 wherein said third filter assembly segment has at least one opening therein positioned such that when said third filter assembly segment is rotated to select said other flow path, said at least one opening therein registers with said at least one opening in said wall of said first filter assembly segment.

12. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a substantially cylindrical substantially smoke-impervious wall, a mouth end, a rod end, and two substantially semicylindrical fluid flow paths therethrough separated by barrier means, said barrier means being at least substantially smoke-impervious, at least one of said fluid flow paths containing a filter medium; and at least a second filter assembly segment abutting said mouth end of said first filter assembly segment and rotatable relative thereto for selectively directing fluid flow into a smoker's mouth through one of said fluid flow paths, and preventing fluid flow into said smoker's mouth from the other of said fluid flow paths, said second filter assembly segment being a substantially cylindrical hollow cap of an at least substantially smoke-impervious material, said cap having a mouth end and a rod end for fitting over said mouth end of said first filter assembly segment and being closed at its mouth end, and having a substantially semicircular opening in said closed mouth end for registration with one of said semicylindrical fluid flow paths.

13. The filter cigarette of claim 12 further comprising means for retaining said cap against axial displacement relative to said first filter assembly segment.

14. The filter cigarette of claim 13 wherein said retaining means comprises detent means on said cap and said first filter assembly segment.

15. The filter cigarette of claim 12 wherein only one of said fluid flow paths contains a filter medium.

16. The filter cigarette of claim 15 wherein:

said filter medium containing flow path is closed at said rod end by closure means, said closure means being substantially smoke-impervious;

said filter medium is flavored with a flavoring chosen to provide a desired flavor when carried into a smoker's mouth by a current of air substantially at room temperature; and said first filter assembly segment has at least one opening in said wall communicating with said filter medium containing flow path, whereby when said second filter assembly segment is rotated to direct fluid flow through said filter medium containing flow path, air only is drawn through said filter medium containing flow path, carrying said flavoring into said smoker's mouth.

17. The filter cigarette of claim 15 further comprising a third filter assembly segment adjacent said rod end of said first filter assembly segment for selectively directing smoke flow from said tobacco rod through one of said fluid flow paths, and excluding it from the other of said fluid flow paths, whereby:

when said second and third filter assembly segments are rotated to select said filter medium containing flow path filtered smoke is delivered to said smoker's mouth; and when said second and third filter assembly segments are rotated to select said other flow path unfiltered smoke is delivered to said smoker's mouth.

18. The filter cigarette of claim 17 wherein said third filter assembly segment is a substantially cylindrical cap of an at least substantially smoke-impervious material, said cap having an open end for fitting over said rod end of said first filter assembly segment and having a substantially semicircular opening in the end opposite said open end for registration with one of said semicylindrical fluid flow paths.

19. The filter cigarette of claim 18 further comprising means for retaining said third filter assembly segment against axial displacement relative to said first filter assembly segment.

20. The filter cigarette of claim 19 wherein said retaining means comprises detent means on said second and third filter assembly segments.

21. The filter cigarette of claim 17 wherein:

said first filter assembly segment has at least one opening in said wall communicating with said filter medium containing flow path; and said filter medium is flavored with a flavoring chosen to provide a desired flavor when carried into a smoker's mouth by a current of air substantially at room temperature: whereby:

when said second filter assembly segment is rotated to select said filter medium containing flow path and said third filter assembly segment is rotated to select said other flow path, said filter medium containing flow path is closed at said rod end, said other flow path is closed at said mouth end, and air only is drawn through said filter medium containing flow path, carrying said flavoring into said smoker's mouth.

22. The filter cigarette of claim 21 wherein said third filter assembly segment has at least one opening therein positioned such that when said third filter assembly segment is rotated to select said other flow path, said at least one opening therein registers with said at least one opening in said wall of said first filter assembly segment.

23. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a substantially cylindrical substantially smoke-impervious wall, a mouth end, a rod end, and two substantially semicylindrical fluid flow paths therethrough separated by barrier means, said barrier means being at least substantially smoke-impervious, one of said fluid flow paths containing a flavoring medium, one of said fluid flow paths being closed at the rod end thereof by closure means, said closure means being at least substantially smoke-impervious; and a second filter assembly segment abutting said mouth end of said first filter assembly segment and rotatable relative thereto for selectively directing fluid flow into a smoker's mouth through one of said fluid flow paths, and preventing fluid flow into said smoker's mouth from the other of said fluid flow paths.

24. The filter cigarette of claim 23 wherein said second filter assembly segment is a substantially cylindrical cap of an at least substantially smoke-impervious material, said cap having an open end for fitting over said mouth end of said first filter assembly segment and having a substantially semicircular opening in the end opposite said open end for registration with one of said semicylindrical fluid flow paths.

25. The filter cigarette of claim 24 further comprising means for retaining said cap against axial displacement relative to said first filter assembly segment.

26. The filter cigarette of claim 25 wherein said retaining means comprises detent means on said first and second filter assembly segments.

27. The filter cigarette of claim 23 wherein only one of said fluid flow paths contains a flavored filter medium, the other of said fluid flow paths containing an unflavored filter medium.

28. The filter cigarette of claim 27 wherein:

said flavored medium is flavored with a flavoring chosen to provide a desired flavor when carried into a smoker's mouth by a current of air substantially at room temperature; and said flavored medium containing flow path is closed by said closure means, said first filter assembly segment having at least one opening in said wall communicating with said flavored medium containing flow path, whereby when said second filter assembly segment is rotated to direct fluid flow through said flavored medium containing flow path, air only is drawn through said flavored medium containing flow path, carrying said flavoring into said smoker's mouth.

29. A filter cigarette, comprising:

a substantially cylindrical tobacco rod;

a substantially cylindrical filter assembly; and tipping paper circumscribing and joining said filter assembly and said tobacco rod; wherein:

said filter assembly comprises:

a first filter assembly segment having a substantially cylindrical substantially smoke-impervious wall, a mouth end, a rod end, and two substantially semicylindrical fluid flow paths therethrough separated by barrier means, said barrier means being at least substantially smoke-impervious, one of said fluid flow paths containing a flavored filter medium, the other of said fluid flow paths containing an unflavored filter medium;

a second filter assembly segment abutting said mouth end of said first filter assembly segment and rotatable relative thereto for selectively directing fluid flow into a smoker's mouth through one of said fluid flow paths, and preventing fluid flow into said smoker's mouth from the other of said fluid flow paths; and a third filter assembly segment adjacent said rod end of said first filter assembly segment for selectively directing smoke flow from said tobacco rod through one of said fluid flow paths, and excluding it from the other of said fluid flow paths, whereby:

when said second and third filter assembly segments are rotated to select said flavored medium containing flow path flavored filtered smoke is delivered to said smoker's mouth; and when said second and third filter assembly segments are rotated to select said other flow path unflavored filtered smoke is delivered to said smoker's mouth.

30. The filter cigarette of claim 29 wherein:

said second filter assembly segment is a substantially cylindrical cap of an at least substantially smoke-impervious material, said cap having an open end for fitting over said mouth end of said first filter assembly segment and having a substantially semicircular opening in the end opposite said open end for registration with one of said semicylindrical fluid flow paths: and said third filter assembly segment is a substantially cylindrical cap of an at least substantially smoke-impervious material, said cap having an open end for fitting over said rod end of said first filter assembly segment and having a substantially semicircular opening in the end opposite said open end for registration with one of said semicylindrical fluid flow paths.

31. The filter cigarette of claim 30 further comprising:

means for retaining said second filter assembly segment against axial displacement relative to said first filter assembly segment; and means for retaining said third filter assembly segment against axial displacement relative to said first filter assembly segment.

32. The filter cigarette of claim 31 wherein:

said means for retaining said second filter assembly segment against axial displacement comprises detent means on said first and second filter assembly segments; and said means for retaining said third filter assembly segment against axial displacement comprises detent means on said first and third filter assembly segments.

33. The filter cigarette of claim 29 wherein:

said first filter assembly segment has at least one opening in said wall communicating with said flavored medium containing flow path; and said flavored medium is flavored with a flavoring chosen to provide a desired flavor when carried into a smoker's mouth by a current of air substantially at room temperature; whereby:

when said second filter assembly segment is rotated to select said flavored medium containing flow path and said third filter assembly segment is rotated to select said other flow path, said flavored medium containing flow path is closed at said rod end, said other flow path is closed at said mouth end, and air only is drawn through said flavored medium containing flow path, carrying said flavoring into said smoker—s mouth.

34. The filter cigarette of claim 33 wherein said third filter assembly segment has at least one opening therein positioned such that when said third filter assembly segment is rotated to select said other flow path, said at least one opening therein registers with said at least one opening in said wall of said first filter assembly segment.

* * * * *

UNITED STATES PATENT AND TRADEMARK OFFICE

CERTIFICATE OF CORRECTION

PATENT NO. : 4,848,375

DATED : July 18, 1989

INVENTOR(S) : Gregorio I. Patron et al.

It is certified that error appears in the above-identified patent and that said Letters Patent is hereby corrected as shown below:

Column 1, line 33, "increasing s" should be -- increasing --.

Column 3, line 7, "1--and" should be -- 13--and --.

Claim 12, column 7, line 36, after "rod" should be inserted -- end, said cap being open at its rod --

Claim 33, column 10, line 58, "smoker--s" should be -- smoker's --.

Signed and Sealed this

Tenth Day of December, 1991

*Attest:*

HARRY F. MANBECK, JR.

*Attesting Officer*

*Commissioner of Patents and Trademarks*